US010071019B2

(12) United States Patent
Lüpges

(10) Patent No.: US 10,071,019 B2
(45) Date of Patent: Sep. 11, 2018

(54) PORTABLE TEMPERATURE-REGULATING APPARATUS FOR MEDICAMENTS

(75) Inventor: Peter Lüpges, Wegberg (DE)

(73) Assignee: Peter Lüpges, Wegberg (DE)

( * ) Notice: Subject to any disclaimer, the term of this patent is extended or adjusted under 35 U.S.C. 154(b) by 344 days.

(21) Appl. No.: 14/241,591

(22) PCT Filed: Jul. 26, 2012

(86) PCT No.: PCT/EP2012/064647

§ 371 (c)(1),
(2), (4) Date: Feb. 27, 2014

(87) PCT Pub. No.: WO2013/014219

PCT Pub. Date: Jan. 31, 2013

(65) Prior Publication Data

US 2014/0230454 A1 Aug. 21, 2014

(30) Foreign Application Priority Data

Jul. 27, 2011 (DE) ..... 10 2011 079 908

(51) Int. Cl.
*F25B 21/00* (2006.01)
*F25B 21/02* (2006.01)
(Continued)

(52) U.S. Cl.
CPC ..... *A61J 1/165* (2013.01); *F25B 21/04* (2013.01)

(58) Field of Classification Search
CPC . F25B 21/00; F25B 21/02; F25B 21/04; A61J 1/18; A61J 2200/70; A61J 2200/44;
(Continued)

(56) References Cited

U.S. PATENT DOCUMENTS 3,148,515 A * 9/1964 Jentis ..... A61M 5/003 62/222
4,407,133 A 10/1983 Edmonson
(Continued)

FOREIGN PATENT DOCUMENTS

DE 197 39 348 5/1998
DE 202 12 890 10/2002
(Continued)

OTHER PUBLICATIONS

International Search Report and Written Opinion for corresponding patent application No. PCT/EP2012/064647 dated Nov. 6, 2012.
(Continued)

*Primary Examiner* — Frantz Jules
*Assistant Examiner* — Erik Mendoza-Wilkenfe
(74) *Attorney, Agent, or Firm* — Renner, Otto, Boisselle & Sklar, LLP

(57) ABSTRACT

The invention relates to a portable apparatus for regulating the temperature of medicaments in solid or liquid form. A temperature-regulating apparatus according to the invention comprises a housing with at least one accommodating chamber, with at least one temperature-regulating device for regulating the temperature of the accommodating chamber, in particular a thermoelectric temperature-regulating device, with at least one inputting means capable of registering an insertion of a medicament container into the accommodating chamber or an immediately imminent insertion, and of controlling the temperature-regulation of the accommodating chamber depending thereon.

9 Claims, 3 Drawing Sheets

Figure 1:
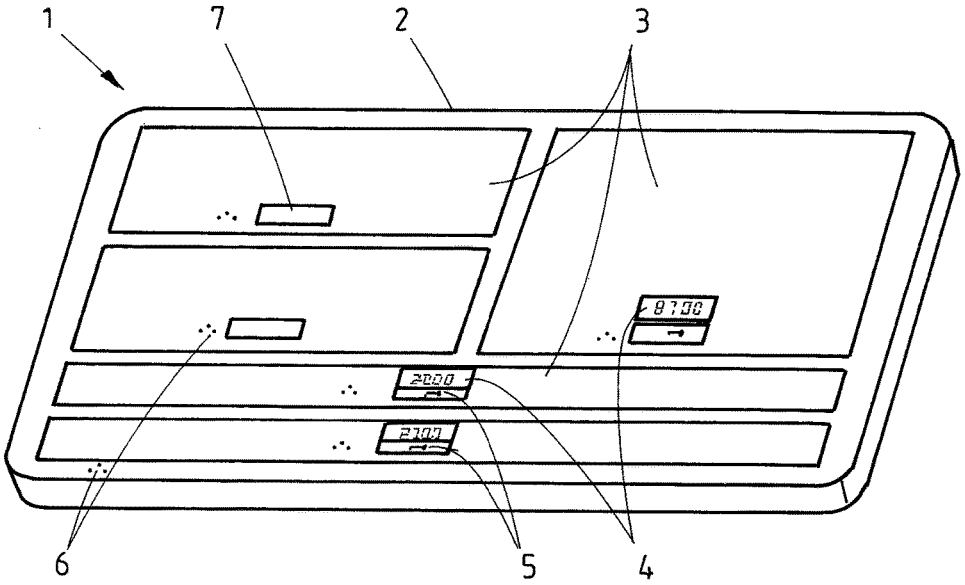

(51) Int. Cl.

| | |
|---|---|
| ***F25B 21/04*** | (2006.01) |
| ***A61J 1/18*** | (2006.01) |
| ***A61J 9/02*** | (2006.01) |
| ***A61M 5/14*** | (2006.01) |
| ***A61J 1/16*** | (2006.01) |

(58) Field of Classification Search

CPC ..... A61J 1/165; A61J 9/02; A61J 2200/72; A61J 2200/74; A61J 2200/76; A61J 2200/40; A61J 2200/042; A61J 2200/04; A61M 1/0068; A61M 5/14; A61M 5/145; A61M 5/44; A61M 2205/3368; A61M 2205/3372

See application file for complete search history.

(56) References Cited

U.S. PATENT DOCUMENTS

| | | | | | |
|---|---|---|---|---|---|
| 4,453,385 | A * | 6/1984 | May | B01L 7/00 | 62/3.62 |
| 4,459,825 | A * | 7/1984 | Crouch | A01N 1/02 | 62/404 |
| 4,581,898 | A * | 4/1986 | Preis | F25B 21/02 | 62/3.62 |
| 4,920,763 | A * | 5/1990 | Provest | F25D 17/02 | 62/378 |
| 5,572,872 | A * | 11/1996 | Hlavacek | A47G 23/04 | 62/3.3 |
| 5,603,220 | A | 2/1997 | Seaman | | |
| 5,704,223 | A * | 1/1998 | MacPherson | A61J 1/165 | 62/3.62 |
| 5,970,719 | A * | 10/1999 | Merritt | A47J 36/2433 | 62/3.2 |
| 6,370,883 | B1 * | 4/2002 | Kugel | B67D 1/02 | 62/3.64 |
| 7,047,762 | B2 * | 5/2006 | Luzaich | A23L 3/00 | 62/3.2 |
| 9,492,607 | B2 * | 11/2016 | Kamen | A61M 5/14244 | |
| 2003/0074903 | A1 * | 4/2003 | Upadhye | A47J 36/2438 | 62/3.3 |
| 2004/0140304 | A1 * | 7/2004 | Leyendecker | A47J 36/2433 | 219/386 |
| 2006/0079765 | A1 * | 4/2006 | Neer | A61M 5/007 | 600/432 |
| 2006/0231109 | A1 * | 10/2006 | Howell | A61B 5/6887 | 128/898 |
| 2006/0248902 | A1 * | 11/2006 | Hunnell | F25B 21/02 | 62/3.6 |
| 2008/0022696 | A1 | 1/2008 | Welle et al. | | |
| 2009/0100843 | A1 * | 4/2009 | Wilkinson | F25B 21/02 | 62/3.7 |
| 2009/0145793 | A1 * | 6/2009 | Hyde | A61B 19/026 | 206/438 |
| 2010/0106625 | A1 * | 4/2010 | McCoy | G06Q 10/087 | 705/28 |
| 2010/0282762 | A1 * | 11/2010 | Leonard | B65D 81/3841 | 220/592.01 |
| 2012/0137706 | A1 * | 6/2012 | Hussain | G06K 19/07749 | 62/3.6 |
| 2012/0312031 | A1 * | 12/2012 | Olsen | F25B 21/02 | 62/3.62 |
| 2013/0008182 | A1 * | 1/2013 | Hrudka | F25B 21/04 | 62/3.6 |

FOREIGN PATENT DOCUMENTS

| | | | |
|---|---|---|---|
| JP | H02-242061 | A | 9/1990 |
| JP | H03-247340 | A | 11/1991 |
| JP | 2003-180797 | | 7/2003 |
| JP | 2003-304977 | A | 10/2003 |
| JP | 2007-125138 | A | 5/2007 |
| WO | 00/41748 | | 7/2000 |
| WO | 2012/048751 | | 4/2012 |

OTHER PUBLICATIONS

Translation of Office Action issued for corresponding Japanese Patent Application No. 2014-522095, dated Feb. 23, 2016.

* cited by examiner

PORTABLE TEMPERATURE-REGULATING APPARATUS FOR MEDICAMENTS

This application is a national phase of International Application No. PCT/EP2012/064647 filed Jul.26, 2012 and published in the English language.

The invention relates to a portable apparatus for regulating the temperature of medicaments in solid or liquid form.

Certain diseases such as diabetes or allergies require the regular administration of medicaments. However, the action and storage life of many medicaments degrades under the influence of temperature or other ambient conditions. In the worst case, medicaments stored incorrectly may even have dangerous effects on the patient. Furthermore, it is important with regard to the optimal action of the medicaments that they are administered at a different temperature to the temperature which is to be maintained in order to properly store the medicament.

Consequently, the mobility of patients that have to use such medicaments regularly is severely limited. The known apparatuses for regulating the temperature of medicaments are generally unwieldy, difficult to transport and limited as regards their function.

US 2009/0100843 A1 discloses a portable cooler for medicaments. The cooler has receptacles for the medicaments to be cooled, a thermoelectric cooling system which releases the heat to the surroundings via cooling ribs in the interior of the housing, and a display for displaying user information.

However, such a cooler is of limited use for mobile application because the dimensions are bulky and the service life and operating time of the cooler are severely limited.

A portable cooling device for cooling medicaments is known from document US 2008/0022696 A1. A chamber of the cooling device can be adapted to the shape of a medicament container. An aerogel insulator, for example, is provided as an insulator. The cooling device furthermore comprises thermoelectric elements adjacent to the chamber walls.

Documents U.S. Pat. Nos. 5,713,208, 5,865,032 discloses further examples of cooling devices for medicaments that comprise thermoelectric elements.

There are medicaments that are stored in a medicament container which can be connected to a hollow needle for administering a medicament dose. Thus, if a patient is to be supplied with a medicament, the hollow needle is attached to the medicament container for example by means of a screwing process with corresponding threads. Thereafter, a desired dose can be injected using the medicament container, which has now been converted into a syringe. Such a medicament container usually contains several times the amount of a single dose. After a dose has been administered, the medicament container with the remaining content therefore has to be cooled again until the next dose is administered.

Such a medicament container which can be converted into a syringe at the same time can comprise a mechanism in order to be able to inject or administer a desired quantity of a medicament in a precise manner, even by a patient, i.e. a layman. Subsequent to an administration of a medicament dose, the used needle must be replaced with a sterile needle to administer a next dose, so as to avoid inflammation. Due to idleness, many patients do not replace the needle in this manner, which can promote inflammation, for example.

The invention is based on the object of providing an improved mobile temperature-regulating apparatus of the type mentioned in the introduction.

In order to achieve the object, a temperature-regulating apparatus for medicaments is provided which comprises a housing with at least one accommodating chamber for a medicament container. Thus, the accommodating chamber is intended and suitable to accommodate a medicament container. Subsequent to inserting the medicament container into the accommodating chamber, the accommodating chamber can be closed in order to minimize energy loss during a temperature-regulating process. The accommodating chamber, i.e. the inner space of the accommodating chamber, is preferably positively adapted to a medicament container located in the accommodating chamber in order to minimize the energy required for temperature regulation of the medicament located in the medicament container. In order to regulate the temperature of a medicament located in a medicament container located in the accommodating chamber, the temperature-regulating apparatus comprises a temperature-regulating device, particularly a thermoelectric temperature-regulating device. In principle, the temperature-regulating device comprises a power source, in particular an electrical power source in the form of a battery or of a rechargeable battery. Preferably, this temperature-regulating apparatus serves for regulating the temperature of medicament containers that are simultaneously designed as administering containers for administering a dose of a medicament, with the medicament container initially containing several times the amount of such a dose. Subsequent to the administration of a dose, such a medicament container must therefore be temperature-regulated again. In particular, the temperature-regulating apparatus serves for regulating the temperature of medicament containers that can be converted into syringes. Therefore, the invention in one embodiment also relates to a temperature-regulating apparatus in which a medicament container is disposed for temperature regulation, wherein the medicament container, at the same time, is an administering container or can be configured as an administering container.

This temperature-regulating apparatus according to the invention comprises at least one of the features mentioned below, or is configured in at least one of the ways mentioned below in order to achieve the object of the invention.

In one embodiment the temperature-regulating device is configured in such a way that it is capable of regulating the temperature of only a partial area of the accommodating chamber.

Generally, a medicament is located only in a partial area of a medicament container. This particularly applies to medicaments located in a medicament container configured as a syringe or which can be converted into a syringe, i.e. connected with a hollow needle that generally consists of metal. A portion of such a medicament container comprises a mechanism, e.g. a movable piston, in order to be able to press the medicament through a hollow needle out from the medicament container using the piston. A mechanism for being able to very precisely move the piston, for example by means of rotary movements, at least in the direction of the area which includes or can include the hollow needle, can be provided additionally. This part of the medicament container, which comprises, for example, a piston as well as, optionally, a mechanism for moving the piston, need not be temperature-regulated in order to suitably regulate the temperature of the medicament located in the container. Since such a mechanism, including the piston, is connected to the medicament container, this mechanism, including the piston, is also disposed in the temperature-regulating apparatus when the medicament container has been inserted into the accommodating chamber. It is therefore sufficient to be able to regulate the temperature of only a partial area of the accommodating chamber in order to keep the medicament at the desired temperature. Therefore, the temperature-regulating device is designed and configured in such a way that it is capable of regulating the temperature of only this partial area of the accommodating chamber in order to thus minimize the energy demand for the desired temperature regulation and therefore enable long operating times of the temperature-regulating apparatus independent from an external power source. In particular, temperature-regulating elements, such as, for example, thermoelectric temperature-regulating elements are disposed adjacent to such areas in which the part or section of the medicament container comprising the medicament is disposed given proper insertion. Temperature-regulating elements thus particularly do not adjoin such areas or sections of the accommodating chamber in which, given proper insertion, the section or area of a medicament container is disposed that does not contain any medicament, but, for example a mechanism and a piston. If the temperature-regulating apparatus is configured so as to be capable of temperature regulation independently from a stationary power source, for example by means of a battery of the temperature-regulating apparatus, then the temperature can be regulated over a particularly long period of time independently from a stationary power source. Long operating times are therefore possible. The mobility of the temperature-regulating apparatus is improved accordingly.

Generally, the accommodating chamber has an elongate shape. In that case, the temperature-regulating device is basically configured in such a way that it is temperature-regulated only over a partial distance along the extended form, generally starting at one end of the elongate form up to a middle area located between the two end areas of the elongate form. One or more cooling and/or heating elements, preferably Peltier elements, i.e. thermoelectric elements, are in that case disposed along a section adjacent to the accommodating chamber, and not along the entire elongate form. In that case, the temperature-regulating device is configured in such a way that not the entire length of the accommodating chamber is or can be temperature-regulated, but only a section thereof. The one or more cooling and/or heating elements, which can preferably be operated electrically, can be disposed distributed around the circumference of the accommodating chamber, or only at one long side of the accommodating chamber. Particularly the area or section of the accommodating chamber that is to be temperature-regulated and to which the one or more cooling and/or heating elements is adjacent consists of metal or a material with a comparably good thermal conductivity. Copper or aluminum is preferably provided as a metal. Furthermore, the accommodating chamber is formed by a material of relatively poor thermal conductivity, particularly by plastic, in order to keep the weight of the temperature-regulating apparatus low and thus increase mobility.

In one embodiment the temperature-regulating apparatus comprises an alignment device which permits an insertion of the medicament container in only one direction or exactly one manner. It is thus ensured that the area or section of an inserted medicament container in which the medicament is located can be or is temperature-regulated. The medicament container can therefore not be brought into the accommodating chamber in such a way that an area of the medicament container is subsequently temperature-regulated in which no medicament is located.

In one embodiment, the alignment device comprises a fastening means, in particular a thread, a bayonet connecting means or a latching means for detachably fastening the medicament container. Fastening the medicament container in the accommodating chamber limits the mobility within the accommodating chamber. It is thus ensured in a further improved manner that the area of the inserted medicament container comprising the medicament is temperature-regulated.

If the medicament container is configured in such a way that it can be converted into a syringe, then the medicament container comprises a section to which a hollow needle can be detachably fastened. This section comprises, for example, an external thread onto which the internal thread of a hollow needle can be screwed. In particular, the fastening means of the medicament container is configured in such a way that this section of the medicament container at the same time serves for fastening in the accommodating chamber. Thus, if a hollow needle is, for example, screwed onto the medicament container by means of a thread, then the fastening means of the temperature-regulating apparatus comprises a thread corresponding therewith, in particular an internal thread, in order to be able to connect the thread of the medicament container to the thread of the fastening means by screwing.

If, for example, a hollow needle is connected to the medicament container by means of a latching connection in order to convert the medicament container into a syringe, then the fastening means comprises a latching means corresponding therewith. The same applies, mutatis mutandis, for the case of a bayonet connection or another manner of connection which is provided for fastening a hollow needle to a medicament container in such a way that there is a syringe with which the medicament stored in the medicament container can be administered by injection. In this embodiment, in which the medicament container can be converted into a syringe, the fastening means on the one hand serves for aligning the medicament container, since only one attachment direction or manner of fastening is possible. On the other hand, it is thus ensured that, subsequent to use, i.e. to the administration of a medicament dose, the needle has to be removed from the medicament container in order to be able to fasten the medicament container in the accommodating chamber and, subsequent thereto, to store and temperature-regulate it. It is thus avoided that, subsequent to an administration of a medicament dose, the needle is not removed due to idleness or due to inattentiveness and replaced with a new, unused needle prior to a subsequent administration of a medicament dose.

To configure the temperature-regulating apparatus in such a way that temperature regulation is possible only after a needle has been removed subsequent to the administration of a medicament dose, constitutes an independent invention with which it is avoided that an already used and therefore non-sterile hollow needle is not replaced due to idleness. In order to achieve the above-mentioned effects, this temperature-regulating apparatus is not necessarily configured in such a way that only a partial area of the accommodating chamber is temperature-regulated for the medicament. Thus, this temperature-regulating apparatus can also be configured in such a way that the accommodating chamber is temperature-regulated over its entire area, i.e., that one or more cooling and/or heating elements, for example, are disposed along the entire length of the accommodating chamber as well as adjacent to the accommodating chamber. This temperature-regulating apparatus, which relates to an independent invention independent from the configuration including the partial temperature regulation of the accommodating chamber, comprises a housing with at least one accommodating chamber for a medicament container, wherein the accommodating chamber, i.e. the inner space of the accommodating chamber, is preferably positively adapted to a medicament container located in the accommodating chamber, as well as a temperature-regulating device with which the accommodating chamber and thus, also a medicament container in the accommodating chamber, can be temperature-regulated.

In one embodiment of the invention, the temperature-regulating apparatus comprises a storage chamber for storing one or more needles. The reliable availability to the patient of unused needles is thus promoted, which promotes the use of a new needle as soon as a next medicament dose is to be administered.

The fastening means preferably comprises a detector that is capable of detecting the fastening of a medicament container. The detector can be, for example, a micro switch which is actuated once the medicament container is fastened. A capacitive or inductive detector can be used as a detector. Temperature regulation can be carried out only subsequent to such an actuation of the detector, as well as preferably only for the duration of the actuation. In this embodiment, it is avoided that temperature regulation is carried out if no medicament container is disposed in the temperature-regulating apparatus.

In one embodiment of the invention the accommodating chamber comprises a replaceable insert which preferably consists entirely or partially of metal. This embodiment makes it possible to select and use an insert depending on the geometry of the medicament container. If the geometry of the medicament container to be temperature-regulated changes, it is sufficient if the insert in the accommodating chamber is replaced in order to be able to temperature-regulate a medicament container with a modified geometry. Every single insert is preferably adapted to the geometry of every single medicament container, i.e. shaped inside so as to be complementary to the medicament container in order thus to minimize the volume to be temperature-regulated. Every single insert thus surrounds the medicament container in a preferably positive manner and has a geometry that is complementary thereto. This configuration is not to be combined mandatorily with the above-mentioned embodiments, but represents an independent invention. It solves the problem that a temperature-regulating apparatus can be modified with minimal effort in such a way that, depending on the geometry of a medicament container, the geometry in the accommodating chamber can be suitably adapted in order to minimize the energy demand for temperature regulation. This temperature-regulating apparatus, which relates to an independent invention, furthermore comprises a housing with at least one accommodating chamber for a medicament container, wherein the accommodating chamber is preferably positively adapted to a medicament container located in the accommodating chamber, as well as a temperature-regulating device with which the accommodating chamber can be temperature-regulated. Advantageously, the insert can simultaneously comprise the aforementioned fastening means to which a medicament container can be fastened. In that case, a fastening means can be replaced together with the insert. The insert can advantageously be equipped with one or more cooling and/or heating elements, which can therefore be replaced together with the insert.

The aforementioned insert, which is at least a part of the accommodating chamber, in particular consists of a metal which is coated on the inside with gold in order to be protected well against corrosion and have good thermal conductivity at the same time. Copper is preferred as the metal. If the insert consists only partially of metal, then that area and section of the insert consists of metal into which a section of the medicament holder comes which comprises the medicament. In this embodiment, the insert furthermore preferably consists of a material that has poor thermal conductivity in comparison to the metal, particularly of plastic, for weight-related reasons, in order thus to keep the weight low.

On the whole, it is thus possible to provide a temperature-regulating apparatus which enables long operating times and/or which has a low weight and can therefore be handled in a mobile manner. The weight of a temperature-regulating apparatus according to the invention is, in particular, up to 3 kg, preferably up to 2 kg, particularly preferably up to 1 kg. It may even be possible to provide a temperature-regulating apparatus which (without the medicament container) weighs less than 500 g.

In one embodiment of the invention, the temperature-regulating apparatus comprises a moisture sensor capable of detecting the moisture in the accommodating chamber. Furthermore, there is a control apparatus which controls the temperature regulation depending on the detected moisture. Due to this control by the control apparatus, the accommodating chamber is, in particular, heated and thus dried if an excessively high degree of moisture above a predetermined threshold value is detected or measured and if it is additionally detected by the temperature-regulating apparatus that no medicament container to be temperature-regulated is located in the accommodating chamber. The accommodating chamber is thus protected against corrosion in an improved manner.

In one embodiment of the invention, the temperature-regulating apparatus comprises a filling level sensor, particularly an optical filling level sensor, with which the filling level in a medicament container located in the accommodating chamber can be determined. This embodiment makes it possible to indicate, for example by an acoustical or optical alarm signal, a filling level that is too low and that requires a replacement of the medicament container in the near future. In one embodiment, the temperature-regulating apparatus comprises a loudspeaker and/or a display through which an alarm signal can be outputted, if necessary. Furthermore, this embodiment makes it possible to suitably reduce that area within the accommodating chamber that is to be temperature-regulated. This particularly applies to medicament containers that are or can be configured as syringes. Such a medicament container preferably comprises a piston which, owing to a correspondingly configured mechanism, can only be moved in one direction by a patient. In such medicament containers the volume in which the medicament is situated can only be reduced, but not increased.

In one embodiment of the invention the temperature-regulating apparatus is configured in such a way, or comprises such a detector that is capable of detecting the position of a piston of a medicament container. In this embodiment, the area adjacent to the volume with the medicament located therein can be temperature-regulated depending on the position of the piston. In this embodiment, the detection of the position of a piston can be used to indicate by means of an alarm signal a necessary replacement in the near future of the medicament container.

In one embodiment of the invention, the medicament container comprises a detector which is capable of detecting and counting an insertion and/or removal of a medicament container from the accommodating chamber. The temperature-regulating apparatus is thus capable of determining and storing how often a medicament container was removed and reinserted into the accommodating chamber. This embodiment can be used to indicate maintenance intervals and/or to indicate by means of an alarm signal the necessity of replacing the medicament container. In one embodiment, the temperature-regulating apparatus is configured accordingly and comprises the devices and means necessary for this purpose.

In one embodiment of the invention, the temperature-regulating apparatus comprises a disinfecting device with which the accommodating chamber can be disinfected.

In one embodiment of the invention, the temperature-regulating apparatus comprises an, in particular outer, insulating layer that comprises a gel or other substance which is brought into a different state of aggregation at or above room temperature when latent heat is supplied, generally from solid to liquid. The temperature for a phase transition is, in particular, between 21° C. and 30° C. In the case of an excessively warm environment above room temperature, the temperature-regulating apparatus is thus reliably protected against an excessively high heat supply into the accommodating chamber, without a considerable increase of, for example, electrical power for operating electrical heating and/or cooling elements being connected therewith. Basically no phase transition occurs at room temperature. It is thus avoided that the period in which the temperature can be regulated without connection to an external power source is significantly shortened by significantly increased ambient temperatures.

In one embodiment of the invention, the temperature-regulating apparatus comprises an, in particular inner, insulating layer that comprises a gel or other substance which is brought into a different state of aggregation at temperatures significantly below room temperature when latent heat is supplied, in particular from solid to liquid. In particular, such a phase transition occurs at a temperature below 12° C., preferably below 8° C. Preferably, this phase transition occurs at temperatures above 0° C., particularly preferably at temperatures above 2° C., particularly preferably at temperature above 4° C. This embodiment contributes to being able to keep a medicament sufficiently cool over a longer period of time, independently from an external power supply, even if an electrical or other temperature regulation fails.

If two layers are provided which are able to ensure long operating times by phase transition, then the layer in which the phase transition occurs at relatively low temperatures is enveloped by the layer in which the phase transition occurs at relatively high temperatures. The two layers surround the accommodating chamber wholly or partially, preferably at least the area into which the medicament can get.

Generally, the temperature-regulating apparatus according to the invention in one embodiment comprises an accommodating chamber which is wholly or partially enveloped by at least one layer comprising a gel or other substance that is brought into a different state of aggregation at temperatures between 0° C. and 30° C. when latent heat is supplied, in order thus to be able to ensure long operating times.

In one embodiment of the invention the inner walls of the accommodating chamber consist entirely or partially of metal, in particular copper. Preferably the inner face of the accommodating chamber is coated with gold in order to avoid adverse effects due to corrosion. On the one hand, a suitable temperature regulation is thus possible in a reliable manner. On the other hand, a good protection against corrosion is provided due to the gold coating. Preferably, only a part of the accommodating chamber comprises metallic walls, i.e. the area in which a medicament container arrives with a section in which the medicament is located. Furthermore, the accommodating chamber is preferably manufactured from a material with relatively poor thermal conductivity, such as plastic. This area, which consists of a material with relatively poor thermal conductivity, is preferably configured as a cap into which a medicament container located in the accommodating chamber generally extends partially. This embodiment makes it possible to keep the technical effort small for producing an accommodating chamber consisting in part of metal and in part of another material, because as a rule, a cap in any case has to be manufactured independently of a container that is a part of the accommodating chamber. Preferably, the cap is dimensioned in such a way that the cap extends, or is capable of extending, into the area of the medicament container that is not filled with the medicament. The one or more heating and/or cooling elements with which temperature regulation can be carried out in a controlled manner are then preferably attached to the container.

In one embodiment of the invention, one or more thermoelectric elements, such as Peltier elements, are attached to a metal, in particularly fastened thereto, which is able to contact the medicament container. The thermoelectric elements are in that case fastened to the outside of the accommodating chamber, for example welded thereto. The one or more thermoelectric elements, such as, for instance, Peltier elements, serve for the temperature regulation of the medicament in the medicament container that has been inserted into the accommodating chamber. The distribution of the thermoelectric elements on the outside is limited, as a matter of principle, to the limited area of the accommodating chamber that is to be temperature-regulated.

In one embodiment of the invention, the temperature-regulating apparatus comprises a paraffin storage system as a cold storage system. The paraffin storage system contributes to the temperature regulation of the low-temperature areas.

In one embodiment of the invention, the accommodating chamber comprises a cap with which the accommodating chamber can be closed. If the cap is removed so that the accommodating chamber is no longer closed subsequent thereto, then an inserted medicament container protrudes in such a way that it can be grasped easily. Without the cap, the inner space of the accommodating chamber is therefore shorter than the length of a medicament container provided for this accommodating chamber.

In one embodiment of the invention, a detector is provided, for example a micro switch, a capacitive, inductive or optical sensor, which is capable of detecting whether the accommodating chamber has been closed with the cap. Furthermore, a control apparatus is provided which prevents a temperature regulation if the accommodating chamber has not been closed with the cap. The reliable minimization of the energy consumption is thus accomplished.

In one embodiment, the outer shape of the accommodating chamber is cylindrical, and one end of the cylindrical shape is configured as a cap, preferably as a screw-on cap. If the cap is removed and if a medicament container is disposed in the accommodating chamber, then the former in particular protrudes from the remaining part of the accommodating chamber. The medicament container can then be grasped and removed easily. In particular, the protruding part of the medicament container comprises the section which is not filled with a medicament. Therefore, the area of the cap is, in particular, an area of the medicament container which is not temperature-regulated.

In one embodiment, a flat area with a preferably rectangular or square surface, which comprises further components of the temperature-regulating apparatus, such as, for example, a display, electrical system and/or an electronic system, is attached to the side of the cylindrical shape of the accommodating chamber, i.e. between the two ends of the cylinder. If the cap is removed and if a medicament container is disposed in the accommodating chamber, then the medicament container not only protrudes from the remaining part of the accommodating chamber, but also laterally relative to the flat area which is attached to the side of the cylindrical accommodating chamber. These geometry facilitates the operation of the temperature-regulating apparatus, particularly the removal of a medicament container, or the accommodation of a medicament container in the temperature-regulating apparatus inclusive of an optionally provided fastening in the accommodating chamber. Moreover, it is possible to place the medicament container on a surface, for example on the surface of a desk, in such a way that, on the one hand, it rests on the cylindrical area, and, on the other hand, on the laterally attached flat area, for example with a distal end of this area. In that case, a surface of the laterally attached area is visible, which is in particular configured as a display, or a display. A patient who is, for example, working at a desk is thus able at any time to have a look at the display, for example to inform himself of the operating states. Therefore, this shape also facilitates mobile handling.

Furthermore, the temperature-regulating apparatus, in one embodiment of the invention, is configured in such a way that other information, such as the time, can also be displayed via the display. In that case, the temperature-regulating apparatus can simultaneously be used, for example, as a desk clock. The temperature-regulating apparatus can be configured in such a way that, alternatively or additionally, e-mails and other information, for example, can be called up and displayed via the display.

Preferably, the temperature-regulating apparatus is configured in such a way that it can be connected to an external power source at any time. If, for example, the temperature-regulating apparatus is placed on a desk in an office, it can be electrically connected to an electric socket. In particular in that case, it is not a problem if the temperature-regulating apparatus is simultaneously used in other respects, i.e. for calling up e-mails. A control unit can thus be provided in such a way that such further options of use are possible only if the temperature-regulating apparatus has been connected to an external, in particular electric, power source.

In one embodiment of the invention, the temperature-regulating apparatus comprises different menus that can be selected by the patient and which are preferably intended for different ages. In particular, there is the option of inputting an age of the patient into the temperature-regulating apparatus. Depending on this, an age-appropriate menu is provided. For older ages, a menu in one embodiment therefore comprises particularly large depictions of letters and numbers and/or explanatory graphical representations. If a menu for a younger age is selected by input, then letters, numbers as well as graphical representations are shown smaller, so that a greater variety of information can be shown on the display at the same time.

The above embodiments and features can be combined in any way with a temperature-regulating apparatus comprising a housing with at least one accommodating chamber, as well as at least one temperature-regulating device for regulating the temperature of the accommodating chamber, in particular a thermoelectric temperature-regulating device, with at least one inputting means capable of registering an insertion of a medicament container into the accommodating chamber or an immediately imminent insertion, and of controlling the temperature regulation of the accommodating chamber depending thereon.

In one embodiment, other chambers of the temperature-regulating apparatus to be temperature-regulated comprise one or more features of the above-mentioned accommodating chamber.

All of the above independent temperature-regulating devices can comprise, individually or in combination, one or more of the embodiments mentioned below, in particular an inputting means which is capable of detecting an insertion of a medicament container to be temperature-regulated into a chamber to be temperature-regulated, and, depending thereon, to control the required temperature regulation.

A temperature-regulating device denotes a means for cooling and/or heating the accommodating chamber(s). The temperature-regulating device preferably comprises a thermoelectric element that is suitable both for cooling as well as for heating. Thermoelectric elements, in particular micro-Peltier elements are advantageous in that a quick and precise temperature regulation is possible primarily using small components.

An inputting means substantially includes all means with which an insertion of a medicament container or an immediately imminent insertion can be registered. In particular, the inputting means comprises a micro switch, a capacitive, an inductive and/or an optical sensor. This can be effected, for example, by means of tactile/haptic, acoustical and optical inputting means. Sensors which, disposed in the accommodating chamber, detect an insertion of a medicament container are possible tactile inputting means. Optionally, optical or acoustical sensors that automatically detect an insertion are also suitable. Alternatively or additionally, it is also possible that a user actively registers the insertion of a medicament container by means of the inputting means, thus activating the temperature regulation of an accommodating chamber. Generally, tactile sensors in the form of keys or optical sensors such as scanners or detectors are conceivable which are able to register the intention of the user of inserting a medicament container, and thus of temperature regulation. For example, a user may hold a medicament container in front of an, in particular, optical detector. The detector registers the medicament container and/or a printed label on the medicament container and as a consequence of this detection activates the temperature regulation of an accommodating chamber suitable for this purpose. In particular, the detector registers information on the temperature that is to be provided for the medicament in the medicament container. The user then inserts the medicament container into the accommodating chamber.

The temperature-regulating apparatus makes it possible that the temperature-regulating device can be specifically activated at the required or at least at a particularly suitable point in time, depending on whether a medicament container was inserted into the accommodating chamber and/or whether such an intention was registered by the user, i.e. basically that such an insertion is immediately imminent.

The energy consumption of the temperature-regulating apparatus can thus be reduced and accordingly, a battery or a rechargeable battery can thus be given smaller dimensions. This results in the possibility of designing the temperature-regulating apparatus to be small and/or of additionally being able to achieve a long service life and long operating times.

Analogously, the temperature regulation of an accommodating chamber is deactivated accordingly in one embodiment of the invention when a medicament container is removed, with the inputting means being configured such that it is capable of registering a removal and/or the intention of a removal by the user. Unnecessary temperature regulation following a removal and an associated energy consumption of one or more unused accommodating chambers is thereby avoided. A battery or rechargeable battery can be given appropriately small dimensions, whereby the temperature-regulating apparatus can be configured to be even smaller and/or an even longer service life and longer operating times can be achieved.

In a preferred embodiment of the invention, the accommodating chamber, that is, the inner walls surrounding the cavity of the accommodating chamber, is positively adapted to the medicament container. Positive means that the cavity in the accommodating chamber for accommodating the medicament container substantially has the shape of the medicament container. Preferably, the distance that results between the cavity and the accommodated medicament container is no greater than 4.9 millimeters, particularly preferably no greater than 1.1 mm, particularly preferably no greater than 0.9 mm. This ensures that the accommodating chamber accommodates the medicament container in a space-saving manner. The volume to be temperature-regulated in the accommodating chamber is thus reduced because the medicament container almost completely fills the cavity in the accommodating chamber. Accordingly, the temperature-regulating device requires less energy for the temperature regulation of the accommodating chamber, which also leads to a temperature-regulating apparatus with smaller dimensions and/or to a longer service life and operating time. At the same time, a quick temperature regulation to the desired temperature can thus be achieved. The additional feature of this embodiment constitutes an independent invention, in particular independent from the inputting means.

In one embodiment, the length and/or the width and/or the depth and/or the diameter of the accommodating chamber corresponds to the length and/or the width and/or the depth and/or the diameter of the medicament container. In the case of the accommodating chamber, this means the internal dimensions. Basically, this also ensures that the accommodating chamber accommodates the medicament container in a space-saving manner. The volume to be temperature-regulated in the accommodating chamber is thus reduced because the medicament container almost completely fills the cavity in the accommodating chamber. Accordingly, the temperature-regulating device requires less energy for the temperature regulation of the accommodating chamber, which also leads to a temperature-regulating apparatus with smaller dimensions and/or to a longer service life and operating time. At the same time, a quick temperature regulation to the desired temperature can thus be achieved. The additional feature of this embodiment is capable also of independently achieving the object, in particular independent from the inputting means.

In one embodiment, the accommodating chamber, inside, has a length of 99 mm to 111 mm, preferably to 106 mm, particularly preferably to 103 mm, a width of 79 to 91 mm, preferably to 96 mm, particularly preferably to 93 and/or a depth or height of 19 mm to 31 mm, preferably 26 mm, particularly preferably to 23 mm. An accommodating chamber thus dimensioned is adapted to the typical dimensions of a set of insulin-containing refill car-fridges. Such a set typically is 100 mm long, 20 mm high or deep, and 80 mm wide.

In one embodiment of the invention, an accommodating chamber serving as an administering chamber is provided, which is 169 mm to 181 mm, preferably to 175.5 mm, particularly preferably to 172.5 mm in length, which is 19 mm to 31 mm, preferably to 26 mm, particularly preferably to 23 mm in width and/or depth, or which has a diameter of 19 mm to 31 mm, preferably to 26 mm, particularly preferably to 23 mm. Such an administering chamber is provided for a pen which is 170 mm in length and 20 mm in diameter, with which a medicament can be injected.

In one embodiment of the invention, an accommodating chamber serving as an administering chamber is provided which is 159 mm to 171 mm, preferably to 166 mm, particularly preferably to 163 mm in length, which is 19 mm to 31 mm, preferably to 26 mm, particularly preferably to 23 mm in width and/or depth, or which has a diameter of 19 mm to 31 mm, preferably to 26 mm, particularly preferably to 23 mm. Such an administering chamber is provided for a pen which is 160 mm in length and 20 mm in diameter, with which a medicament can be injected.

The medicament containers can have different shapes, such as, for example, pen sticks, ampoules or vials. In one embodiment of the invention, the temperature-regulating apparatus includes different accommodating chambers for different shapes of medicament containers. Thus, different medicaments can be stored and transported in the temperature-regulating apparatus. Moreover, the differently dimensioned accommodating chambers can be disposed in such a way that an energy-efficient temperature regulation by the temperature-regulating device is possible.

In order to additionally minimize temperature changes in the accommodating chamber during the accommodation and removal of the medicament containers, it is advantageously provided to store medicament containers predominately individually in the accommodating chamber. Heat or cold losses caused by opening the accommodating chamber can be reduced by storing medicaments individually. At the same time, it is also possible to quickly regulate individual medicaments to a desired temperature, which, on the whole, is advantageous with regard to the construction space and/or energy consumption of the temperature-regulating apparatus.

In a preferred embodiment of the invention, the temperature-regulating device is configured such that individual accommodating chambers can be temperature-regulated differently. For example, this enables a temperature regulation of individual accommodating chambers to different temperatures, which are usually storage temperatures of between 2-8° C. The medicaments can thus be temperature-regulated individually to the respective optimum temperature. This is advantageous in particular with regard to the efficacy and/or storage life of the respective medicaments.

In a further embodiment of the invention, an accommodating chamber is furthermore provided which temperature-regulates the accommodated medicament to an administering temperature. The administering temperature of medicaments as a rule is in the range of 15-25° C. Preferably, this accommodating chamber, which is provided as an administering chamber, is provided additionally and/or so as to be thermally insulated. In the case of an additional administering chamber, the user places the medicament into it prior to its application, so that the medicament can be temperature-regulated to the correct administering temperature. An inputting means in the form of a sensor, for example in the form of a micro switch, an optical sensor, a capacitive sensor or an inductive sensor, can register an insertion, for example, and temperature-regulate the administering chamber to the appropriate temperature. Alternatively, it is also possible that no additional administering chamber is provided and that the accommodating chamber is temperature-regulated to an administering temperature after the user has registered via an inputting means the intention of an administration. What is advantageous about an additional and/or thermally insulated administering chamber is that a quick temperature regulation to an administering temperature is possible due to a difference which as a rule exists between the storage temperature and the administering temperature of a medicament. In particular, this is also advantageous for the energy expenditure of the temperature-regulating apparatus, because an additional and/or thermally insulated administering chamber requires smaller temperature changes.

Providing a second accommodating chamber serving as an administering chamber is advantageous in particular if the first accommodating chamber is configured and dimensioned such that it serves for accommodating a plurality of medicament containers designed as refill cartridges. If required, a first refill cartridge is taken from the first accommodating chamber and inserted into a stick pen. The stick pen is then transferred into the second accommodating chamber. The first accommodating chamber is temperature-regulated in accordance with the prescribed storage temperature of the medicament. The second storage chamber is temperature-regulated in accordance with the prescribed administering temperature while the stick pen or medicament container is inserted.

According to a particularly preferred embodiment, the temperature-regulating apparatus comprises a control device, in particular a microprocessor control unit, which is configured such that the temperature-regulating device regulates the temperature efficiently and/or that the selection of the accommodating chamber enables an efficient temperature regulation. Primarily by means of a display, it is thus possible that the control device allocates the appropriate and energetically efficient accommodating chamber after the storage temperature has been detected, for example by a scanner. In particular, this makes an improved service life and operating time of the temperature-regulating apparatus possible.

The temperature-regulating apparatus according to the invention comprises at least one outputting means for information for intuitive user guidance. The outputting means can usually be realized in an optical or acoustical manner. For example, a touch panel, which in addition to an optical outputting means also comprises a tactile/haptic inputting means, can be provided, on which user information can be displayed. User information may include, for example, information read in about medicaments such as storage temperature, administering temperature and storage life. Moreover, it is also possible to show on a display information on the patient received via a communication interface, such as USB or Bluetooth, for example blood sugar levels. Moreover, displays for visual signaling, in particular regarding the condition of the accommodating chambers, and/or loudspeakers for acoustical signaling can be provided. Small displays on the accommodating chamber can, for example, display the temperature and/or the occupancy of the accommodating chamber.

The outputting means enable an improved user guidance and moreover prevent or reduce possible operating errors by the user. In conjunction with the control device, the user can be guided with regard to an energy-efficient and safe use of the temperature-regulating apparatus.

According to another feature of the invention, at least one input device for acquiring information is provided. An input device substantially comprises sensors or data acquisition devices. It is possible to provide tactile/haptic, acoustical and optical input devices on the temperature-regulating apparatus. User inputs and/or information on the medicament can be acquired by means of the input device. Using the above-mentioned touch panel, for example, the user is able to input information directly.

In another embodiment, information which is usually located as a machine-readable code on the medicament container can be read automatically by means of an optical input device, such as a scanner. The information read in may include, among other things, the storage temperature, administering temperature, type of medicament, constructional shape of the medicament container and/or other important information for the user. The control device can then process the information received via the input device, and in particular regulate the temperature of the respective accommodating chamber accordingly. This makes an intuitive interaction possible between the user and the temperature-regulating apparatus. Moreover, information about the medicament can be quickly read in by means of optical input devices, such as scanners, which enables a comfortable and safe use of the temperature-regulating apparatus.

Furthermore, the input device enables an energy-efficient temperature regulation of the accommodating chambers. For this purpose, a medicament is first read in by means of an input device, such as, for example, a bar-code scanner. Depending on the read-in storage temperature and/or administering temperature, the control device selects a suitable accommodating chamber and displays it to the user via an outputting means, such as an LED display. At the same time, this accommodating chamber can then also be temperature-regulated. However, when the medicament is inserted, which is registered by an inputting means such as a detector, the temperature regulation to the read-in storage temperature and/or administering temperature begins at the latest.

In an advantageous embodiment, a weight sensor is provided on an accommodating chamber which is capable of detecting the weight of the accommodated medicament. This can be used additionally for checking the accommodated medicament in order to avoid mix-ups or to visually or acoustically signal, by means of an appropriate outputting means, such as an LED display or a loudspeaker, mix-ups that have occurred. This check is possible by comparing the determined weight with a prescribed weight which was read in, for example, via the input device. In one embodiment, the weight sensor is additionally used for determining when there is no medicament in the accommodating chamber anymore. If the weight sensor determines that there is no medicament in the accommodating chamber anymore, the further temperature regulation of the accommodating chamber is stopped in order thus to minimize energy consumption. In one embodiment, the further temperature regulation is stopped with a delay in time, for example not until it is determined by means of the weight sensor or another sensor that no medicament was located in the accommodating chamber for a period of, for example, at least 30 seconds or at least one minute. This embodiment is particularly suitable if a plurality of medicament containers that are packaged, for example, in a blister pack, is to be stored in the storing chamber. Thus, allowances are made for the fact that the blister pack is first taken out in its entirety from the accommodating chamber, a medicament container is removed from the blister pack, and the blister pack with the remaining medicament containers is then reinserted into the accommodating chamber, which must then be temperature-regulated further. It is not imperative that a weight sensor is provided in this embodiment. A different detector which is able to detect the presence of a medicament in the accommodating chamber is sufficient, such as, for example, an appropriate optical detector which is capable of this.

In one embodiment of the invention, a temperature sensor, by means of which the temperature in the accommodating chamber can be determined, is mounted on or in the accommodating chamber. By determining the actual temperature in the accommodating chamber, the intended temperature can be set exactly by means of the control device, which makes a precise temperature regulation possible.

In order to ensure a safe storage of the medicaments, another embodiment provides to secure one or more accommodating chambers with a locking means. The locking means is capable of preventing accommodating chambers from opening inadvertently. Moreover, erroneous application of medicaments and/or incorrect storage can be prevented by an electrically controlled locking and unlocking of individual accommodating chambers. For this purpose, the control device is configured such that after a medicament has been read in by means of an optical input device, an appropriate accommodating chamber is indicated to the user preferably by means of a display, and this accommodating chamber is promptly unlocked for insertion. After a correct insertion, the accommodating chamber concerned is relocked. Unlocking for removing the medicament accordingly takes place not until a release is effected by the control device, which can preferably be triggered by the user.

In order to be able to quickly regulate the temperature of an accommodating chamber, and in particular cool it, the chamber walls are preferably fabricated from a metal, in particular from aluminum, in order to keep the weight low. Cooling ribs can be provided in order to dissipate heat thereby. Preferably, the heat that is withdrawn during a cooling process is used for melting a substance, such as a salt, in order to be able to quickly dissipate large quantities of heat without having to provide a large volume for this purpose. Above all, the use of a fan can be dispensed with in this case. Heat is withdrawn from an accommodating chamber in particular by means of a thermoelectric element and is supplied to the substance to be melted.

According to a preferred embodiment of the invention, the temperature-regulating apparatus comprises at least one communication means for data. A communication means is capable of establishing a connection between communication devices. Communication can be established by means of a mechanical connection, such as cables, or preferably wirelessly. In addition to data exchange, a cable-bound connection, such as, for example, a USB interface usually also makes it possible to charge a rechargeable battery. In addition to wi-fi, the Bluetooth system is also suitable where wireless connections are concerned. The communication means for data exchange enables a simple transfer of user data between the communication devices. In this way, health-related user data, such as the blood sugar levels of a blood sugar measurement device can be read in, for example, and shown to the user via the display of the temperature-regulating apparatus.

In a preferred embodiment of the invention, a communication means for an identification of communication devices is provided. A wireless identification, such as in the case of the RFID system, is advantageous. The communication means on the temperature-regulating apparatus then recognizes wirelessly the associated communication device, which is located, in particular, in the vicinity of the temperature-regulating apparatus. Thus, the communication device, such as an RFID transponder, can be identified for a certain user, and the control device can release the medicament to the identified user. It is thus possible to set up the temperature-regulating apparatus for several users. The control device then manages the data of the individual users and their medicaments in the temperature-regulating apparatus. This embodiment is suitable, in particular, for use in hospitals. A patient is identified by means of the communication system, and the administration of the medicament intended for this patient is controlled and/or signaled by the temperature-regulating apparatus.

In another embodiment of the invention, the communication means is configured such that it is capable of transmitting user messages such as warnings, alarms or information. A warning or alarm can thus be transmitted, for example via mobile telephone service, such as, for instance, by means of SMS. In one embodiment of the invention, the user can then be notified by means of a voice message or a text message that a medicament is ready for administration. The temperature-regulating apparatus is thus capable of ensuring regular application of the medicaments and warn or remind the user if necessary.

According to a preferred embodiment of the invention, the temperature-regulating apparatus has a modular configuration. The modularity makes it possible that the temperature-regulating apparatus is assembled from standardized components. Therefore, the temperature-regulating apparatus is capable of being extended in a flexible manner. The standardized components are not only limited to components that provide separate functions, such as, for example, a communication module for Bluetooth, but include modules that enable a flexible extension with at least one accommodating chamber. The extension of the accommodating chamber can be realized mechanically, by means of a connecting means such as a clamping, rotary and/or press-on closure, whereby a quick connection of several modules is made possible.

In another embodiment, a master module is provided which primarily comprises the control device. This master module can be flexibly combined by means of other modules with one or more accommodating chambers and different sizes. It is thus possible to manage several modules using a single master module. Advantageously, the temperature-regulating apparatus is capable of managing several users and their accommodated medicaments by means of a single master module. In particular, it is possible in this embodiment to replace accommodating chambers in order to be able to change the chamber volume if required.

The temperature-regulating apparatus can also serve for the temperature regulation of, for example, organs in the case of an organ transport. A suitably dimensioned accommodating chamber can be added or provided easily in particular in the case of a modular structure.

In order to attain a high thermal insulation and thus a low passage of thermal energy in particular for the accommodating chamber(s), the temperature-regulating apparatus, in a preferred embodiment of the invention, is produced by laser-sintering plastic. Thermal threads, that is, hollow threads, are preferably incorporated into the housing of the temperature-regulating apparatus for improved thermal insulation. At particularly important areas of the housing, they can provide for the passage of thermal energy being reduced.

In one embodiment, the temperature-regulating device comprises a locating device, which comprises a GPS system, for instance. In an emergency, the location of the temperature-regulating device during transport can by determined by means of the locating device, in order thus to be able, for example, to find a user quickly.

In one embodiment, the temperature-regulating device comprises a wireless communication module, such as wi-fi or a mobile telephone connection such as UMTS for external control of the temperature-regulating apparatus. In this way, parameters of the temperature-regulating apparatus can be changed wirelessly, or preferably, a software program can be updated automatically.

Instead of a cap, a temperature-regulating device according to the invention can comprise a lid which is pivotably connected to the accommodating chamber, in order to be able to close the accommodating chamber. A fastening means in the accommodating chamber, which can be connected to the medicament container, can also be configured to be pivotable in order to be able to pivot the fastening means into a suitable position for fastening the medicament container. Subsequent to fastening the medicament container, the medicament container and the fastening means can be pivoted in such a way that the medicament container arrives in the accommodating chamber and that the latter can be closed by a lid or a cap.

In the drawings:

FIG. 1: shows a temperature-regulating apparatus.

Figure 2:
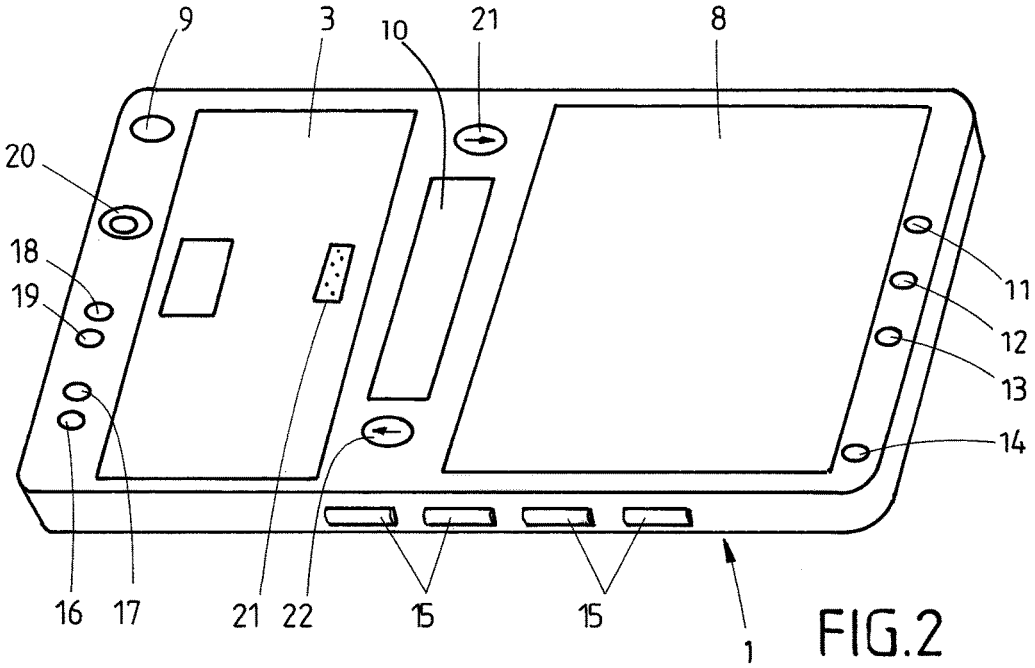

FIG. 2: shows another embodiment of the temperature-regulating apparatus.

Figure 3:
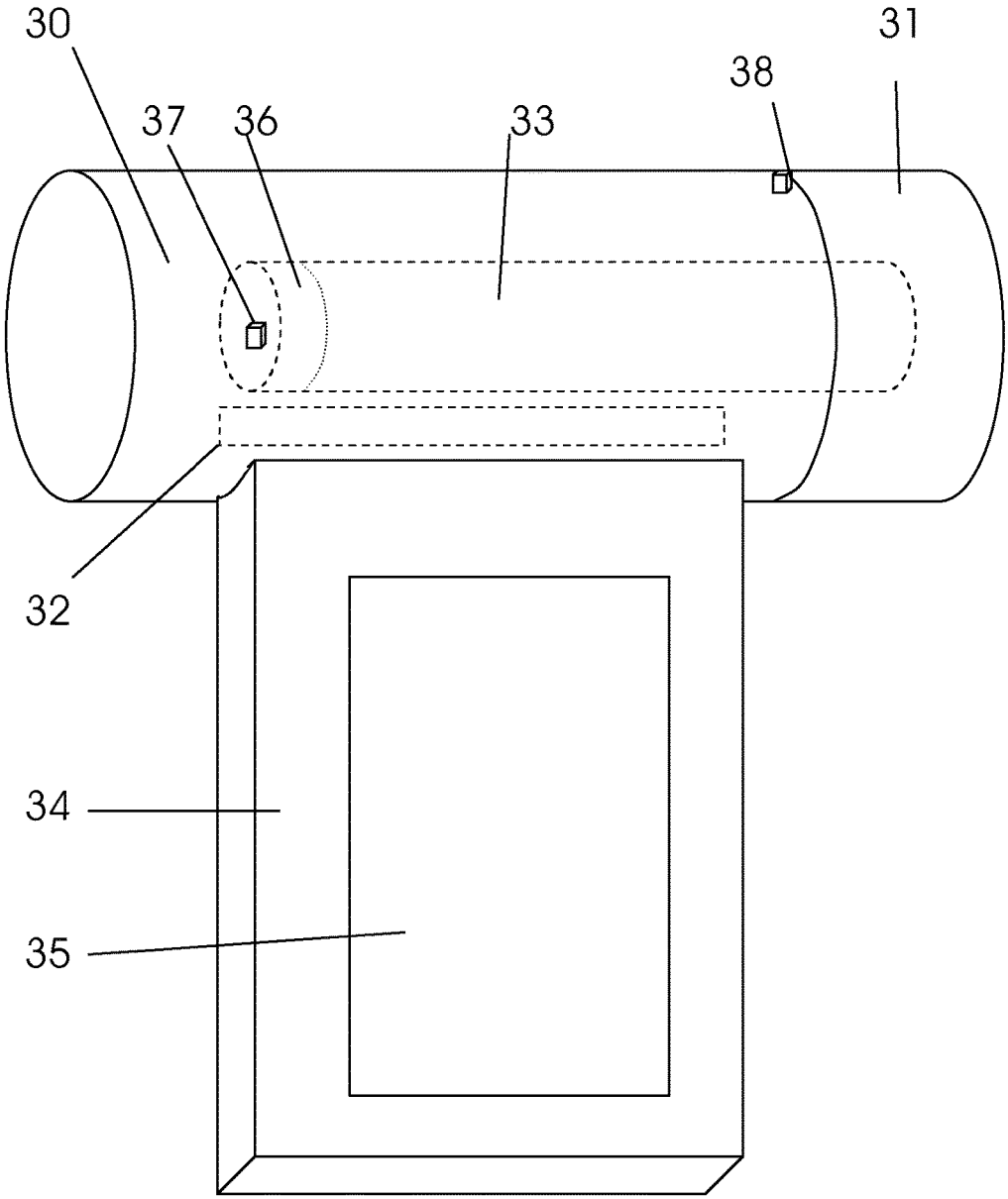

FIG. 3: shows another embodiment of the temperature-regulating apparatus.

Figure 4:
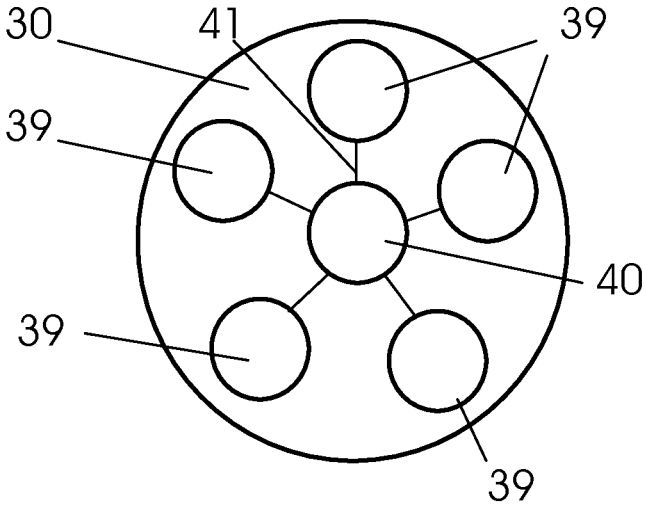

FIG. 4: shows a section of a chamber of the temperature-regulating apparatus according to one embodiment.

The invention is described in detail in the following description with reference to an exemplary embodiment illustrated in the drawings.

A temperature-regulating apparatus 1 is outlined in FIG. 1. The temperature-regulating apparatus 1 comprises a housing 2 with several accommodating chambers 3. The accommodating chambers 3 are configured so as to be lockable. The accommodating chamber can be opened via an unlocking means 7 in the lid of the accommodating chamber 3, provided it was unlocked appropriately in order to enable the removal of the medicament. The status of an accommodating chamber is indicated by several LED status displays 5. The LED displays 5 are capable of showing the status of the accommodating chamber by means of different colors or a flashing cycle. Because of the LED's, for example, the user is able to see, without opening the accommodating chambers 3, which accommodating chambers are currently being temperature-regulated. Moreover, temperature displays 4 are also provided on accommodating chambers 3 so that the user is able to directly read off the temperature.

Accommodating chambers 3 of different sizes are provided for accommodating different medicament containers. In addition to accommodating chambers that accommodate individual medicament containers, for example in the form of pen sticks, accommodating chambers for several ampoules or other medicament containers are also disposed on the temperature-regulating apparatus 1 in a space-saving manner. Moreover, in order to facilitate safe operation by users with impaired vision, the accommodating chambers 3 are labeled in Braille 6.

Another embodiment with an accommodating chamber 3 is shown in FIG. 2. This embodiment comprises a touch screen 8 for displaying relevant user information and for inputs. Information, for example on the operative condition or concerning operation, can be outputted acoustically by means of a loudspeaker 9. A micro-bar-code scanner 10 serves as an inputting means in order to be able to read in machine-readable information on a medicament package and starting a temperature regulation of the accommodating chamber 3 dependent thereon. A rechargeable battery of the temperature-regulating apparatus can be charged and/or data can be exchanged with a computer via a port, such as, for example, a USB port 15. An indicator light 11 serves as a temperature indicator, for example in order to signal by means of a green light that a predetermined temperature in the accommodating chamber 3 has been reached. Another indicator light 12 signals the operative condition of the rechargeable battery. If, for example, this light is lighted green, the rechargeable battery is sufficiently charged. Yellow, for example, signals a necessity for charging. Red signals that the rechargeable battery is almost completely discharged. An indicator light 13 signals the correct connection of a power supply unit. A light sensor 14 regulates the brightness of the respective visual displays in order thus to minimize power consumption. A plurality of other ports 15, such as, for example, USB ports, can be provided, for example in order to connect other modules to the module shown in FIG. 2. An indicator light 16 shows the operative condition of a Bluetooth communication device 1 7. An indicator light 18 shows the operative condition of a wi-fi communication device 19. The temperature-regulating apparatus 1 shown in FIG. 2 comprises an RFID transmitter and/or receiver 20.

A desired temperature in the accommodating chamber 3 can be set manually using keys 21 and 22.

Such a temperature-regulating apparatus can, for example, comprise a module which in addition to one or more rechargeable batteries comprises, for example, a computer unit that is connected, for example, with the embodiment shown in FIG. 1 or FIG. 2. Another module can be an accommodating chamber, which can be provided with its own display devices and the like. The temperature-regulating apparatus, or a module of the temperature-regulating apparatus, can comprise an emergency key in order to be able to initiate an emergency call via mobile phone service. At the same time, an emergency call initiated in this manner expediently comprises information regarding the location of the temperature-regulating apparatus. Moreover, the temperature-regulating apparatus expediently comprises an on/off switch.

FIG. 3 shows another embodiment of a temperature-regulating apparatus which comprises a cylindrical accommodating chamber consisting of a container 30 and a cap 31. The cap 31 can be firmly connected to the container 30, for example through a screwed connection or a latching connection. In particular the cap 31 preferably consists of plastic and, moreover, is equipped with thermally insulating layers and/or materials, such as, for example, foamed materials. Over a part of the longitudinal extent of the accommodating chamber 30, 31, thermoelectric elements 32 are disposed in the area that is shown in dashed lines. The area 32 is dimensioned in such a way that it is adjacent to the area of the medicament container containing the medicament. A control apparatus can be provided which controls the temperature regulation by the thermoelectric elements depending on the position of a piston of the medicament container, in such a way that only that area is heated which comprises the medicament. Such a medicament container 33 which extends into the cap 31 is located within the accommodating chamber. If the cap 31 is removed, then the medicament container protrudes from the rest of the area 30 of the accommodating chamber. The medicament container 33 can then be grasped easily and pulled out from the rest of the area 30 of the accommodating chamber. A flat area with a rectangular surface, which comprises a display 35, is attached to the side of the accommodating chamber 30, 31.

If, for example, the temperature-regulating apparatus shown in FIG. 3 is placed on a desk in such a way that the display 35 is visible, then this display is situated on the surface of the desk in a slightly inclined position, and is thus easily readable. The rectangular area 34 can accommodate further components of the temperature-regulating device.

For insertion, the medicament container 33 is connected to a fastening device 36 by, for example, a thread, i.e. by screwing. The cap 31 is preferably capable of closing the container 30 only when the medicament container 33 is fully connected to the fastening device 36. The fastening device 36 comprises a sensor 37, for example a micro switch or other sensor, with which it is possible to determine whether a medicament container 33 was properly connected to the fastening means 36. However, this sensor may also be omitted if the container 30 can only be closed with the cap 31 if the medicament container 33 has been properly fastened to the fastening means 36. In that case, a sensor or detector is sufficient which is capable of determining whether a medicament container 33 is located in the container 30. It is possible to determine by a sensor 38, for example a micro switch, whether the container 30 was properly closed with the cap 31. The use of a micro switch as a sensor is advantageous in that it does not consume energy, in contrast to other sensors, such as, for example, optical sensors, which can prolong operating life.

In the container 30 an insert can be disposed, which is not shown and which consists, in particular, of metal or at least partially of metal, and which preferably protrudes from the container 30 and in that case can be easily removed and replaced with a different insert. In that case, the medicament container 33 is located wholly or partially within the insert.

The accommodating chamber 30, 31 can be enveloped at least partially by layers that comprise substances that are brought from a liquid state into a solid state by a supply of heat. Preferably, two such layers are provided. The substance in an inner layer is brought into the solid state at a lower temperature, in particular at temperatures between 2° C. and 8° C., compared to the substance in the, relative thereto, outer layer. The substance of the outer layer is preferably brought into the solid state at a temperature of between 20° C. and 30° C. The insulation in the form of one or more such layers can be combined with every one of the embodiments or independent inventions disclosed in this document.

In one embodiment of the invention, the container 30 is configured in such a way that it is capable of accommodating, in addition to a medicament container, one or more refill cartridges for the medicament container, or one or more further medicament containers. A dedicated bore or dedicated chamber, into which a refill cartridge or a medicament container can be pushed, can be provided for each refill cartridge. The different chambers can be interconnected via supply ducts in order to allow for a thermal equalization between the chambers.

FIG. 4 shows a section of a possible design of the chamber 30. A plurality of chambers 39 are grouped around a main climate chamber 40. From the main climate chamber 40, ducts 41 optionally lead to the chambers 39 in a star-shaped manner. An exchange of air is possible between the various chambers 39, 40 via the ducts 41. At least one refill cartridge can be pushed into each chamber 39. Finally, all the chambers 39 and 40 can be closed by a single cap, as shown in FIG. 3. However, it is to be preferred that the chambers 39 are closed by another cap, i.e. not by the cap that is capable of closing the main climate chamber 40. The two caps can be provided at opposite ends of a, for example, cylindrical container 30. The removal of the cap for the main climate chamber 41 prevents the opening process for removing an already used medicament container from causing warm air to be able to flow directly also into the chambers 39, which would increase energy consumption.

If ducts 41 are provided, it can be sufficient if thermoelectric elements are arranged in such a way that primarily the main climate chamber 40 is temperature-regulated by them. The temperature regulation of the further chambers 39 is then effected by an exchange of air through the ducts 41. Preferably, there are exactly five chambers 39 for refill cartridges, because this number was found to be particularly suitable in order to be able to be disposed around a main climate chamber 40 while taking into account the various requirements. In one embodiment, at least one spring is provided in each of the one or more chambers 39, which springs are biased when refill cartridges are located in these chambers 39. The refill cartridges are then immovably located in these chambers 39. Alternatively, a fastening mechanism can in that case be provided in each chamber 39, with which refill cartridges can or must be fastened in each chamber 39 in order to be able to close each chamber 39.

In one embodiment of the invention, several chambers 39 are shut with a rotatable plate with a passage. If the plate is rotated in a suitable manner, access to one of the chambers 39 is provided via the passage. It is thus avoided that, in case of need, all the chambers 39 have to be opened at the same time which would increase energy consumption accordingly. The plate can be pressed against the openings of the chambers 39 by a biased spring. Springs located in the chambers 39 can be used so that an end of a refill cartridge is pushed out if the corresponding chamber is opened.

The invention is particularly suitable for the temperature regulation of insulin.

LIST OF REFERENCE SYMBOLS

1 Temperature-regulating apparatus
2 Housing
3 Accommodating chamber
4 Temperature display
5 LED status display
6 Braille labeling
7 Unlocking means
8 Touch screen
9 Loudspeaker
10 Micro-bar-code scanner
11 Indicator light
12 Indicator light
13 Indicator light
14 Light sensor
15 USB port
16 Indicator light
17 Bluetooth device
18 Indicator light
19 Wi-fi communication device
20 RFID transmitter/receiver
21 Key
22 Key
30 Container
31 Cap
32 Area for thermoelectric elements
33 Medicament container
34 Rectangular surface area
35 Display
36 Fastening device
37 Sensor

38 Sensor
39 Chamber
40 Main climate chamber
41 Duct

The invention claimed is:

1. A temperature-regulating apparatus for medicaments comprising:

a housing with at least one accommodating chamber for a medicament container, wherein the accommodating chamber is elongated along a longitudinal extent between a first end and a second end opposite the first end;

a thermoelectric temperature-regulating device, wherein the temperature-regulating device can temperature-regulate only a partial area of the accommodating chamber, the thermoelectric temperature-regulating device including a plurality of thermoelectric elements that are attached to the accommodating chamber along the longitudinal extent, the plurality of thermoelectric elements extending only over a partial area of the longitudinal extent starting at a location near the first end of the accommodating chamber up to a middle area located between the first end and the second end of the accommodating chamber; and a control device that is configured to adjust a temperature of the partial area of the accommodating chamber that is temperature-regulated in response to a position of a piston of the medicament container, the partial area being adjustable using the thermoelectric elements, wherein the temperature-regulating apparatus includes a filling level sensor for determining a filling level of the medicament container which corresponds to the position of the piston.

2. The temperature-regulating apparatus according to claim 1, wherein an alignment device which permits an insertion of the medicament container in only one direction, wherein the alignment device comprises a thread, a bayonet connector or a latch for detachably fastening the medicament container.

3. The temperature-regulating apparatus according to claim 2 further comprising a detector that is capable of detecting the insertion of the medicament container into the accommodating chamber.

4. The temperature-regulating apparatus according to claim 1, wherein the accommodating chamber is wholly or partially enveloped by at least one layer comprising a gel or another substance that is brought from a liquid state into a solid state at temperatures between 0° C. and 30° C. when latent heat is supplied.

5. The temperature-regulating apparatus according to claim 1 further comprising the medicament container, wherein an internal diameter of the accommodating chamber corresponds to an external diameter of the inserted medicament container, and/or a length of the medicament container corresponds to a length of the accommodating chamber on the inside, and/or a width of the medicament container corresponds to a width of the accommodating chamber on the inside, and/or a depth of the medicament container corresponds to a depth of the accommodating chamber on the inside.

6. The temperature-regulating apparatus according to claim 1 further comprising the medicament container, wherein the accommodating chamber is closeable with a cap and the medicament container located in the accommodating chamber protrudes over the accommodating chamber when the cap is removed.

7. The temperature-regulating apparatus according to claim 6, wherein no thermoelectric elements are provided adjacent to the cap.

8. The temperature-regulating apparatus according to claim 1, wherein at least one inputting means is provided that is capable of registering an insertion of the medicament container into the accommodating chamber or an immediately imminent insertion, and of controlling a temperature regulation of the accommodating chamber depending thereon.

9. The temperature-regulating apparatus according to claim 1, wherein the accommodating chamber is positively adapted to a medicament container located in the accommodating chamber.

* * * * *